US005387502A

United States Patent [19]

Inagaki

[11] Patent Number: 5,387,502

[45] Date of Patent: Feb. 7, 1995

[54] SILVER HALIDE PHOTOGRAPHIC MATERIAL

[75] Inventor: Yoshio Inagaki, Kanagawa, Japan

[73] Assignee: Fuji Photo Film Co., Ltd., Kanagawa, Japan

[21] Appl. No.: 113,359

[22] Filed: Aug. 30, 1993

Related U.S. Application Data

[63] Continuation of Ser. No. 943,034, Sep. 10, 1992, abandoned.

[30] Foreign Application Priority Data

Sep. 11, 1991 [JP] Japan ..... 3-258733

[51] Int. Cl.[6] ..... G03C 1/20

[52] U.S. Cl. ..... 430/584; 430/588

[58] Field of Search ..... 430/584, 588

[56] References Cited

U.S. PATENT DOCUMENTS 2,096,842 10/1937 Brunken et al. ..... 430/588
2,126,078 8/1938 Zeh et al. ..... 430/588
4,975,362 12/1990 Parton et al. ..... 430/584
5,093,226 3/1992 Ohshima ..... 430/584

FOREIGN PATENT DOCUMENTS 418745 10/1934 United Kingdom ..... 430/588

*Primary Examiner*—Janet C. Baxter
*Attorney, Agent, or Firm*—Sughrue, Mion, Zinn, Macpeak & Seas

[57] ABSTRACT

A silver halide photographic material comprises on a support at least one silver halide emulsion layer containing a trimethine dye or a pentamethinecyanine dye each containing an alkylthio-substituted benzoazole nucleus. The photographic material is suitable for forming images using a scanning system that employes a semiconductor laser as a light source. The photographic material has a high sensitivity which does not degrade during storage, and the material does not tend to fog during storage.

2 Claims, No Drawings

SILVER HALIDE PHOTOGRAPHIC MATERIAL

This is a continuation of application Ser. No. 07/943,034 filed Sep. 10, 1992, now abandoned.

FIELD OF THE INVENTION

The present invention relates to a silver halide photographic material, and more particularly to a silver halide photographic material having improved sensitivity and stability.

BACKGROUND OF THE INVENTION

The various methods of forming an image by exposing a photographic light-sensitive material include an image-forming method which employs a so-called scanner system. In a scanner system, an original is scanned and a silver halide photographic material is exposed based on the image signals obtained by scanning to form on the photographic light-sensitive material a negative or positive image corresponding to the image of the original.

There are various kinds of recording apparatus which have been used in practice in image-forming methods that employ scanner systems. As the recording light source for the recording apparatus used in scanner systems, glow lamps, xenon lamps, mercury lamps, tungsten lamps, light emitting diodes, etc., have been used.

These light sources, however have recognized disadvantages for practical use. Typically, their output is weak and their average life is relatively short.

To overcome these disadvantages, scanner systems have been developed that use a coherent laser light source such as an Ne—He laser, an argon laser, an He—Cd laser, etc. By using coherent light sources of this type, a high output is obtained. However, scanner systems using such light sources suffer from disadvantages in that the apparatus is typically large and expensive and a modulator is required. Further, since a visible light is used and the photographic material is necessarily of the type that is sensitive to visible light, the types of safelights that can be used are restricted, so that handling of the light-sensitive materials becomes problematic.

Scanner systems that employ semiconductor lasers have also been developed. Semiconductor lasers have the advantages that the device for the laser is small and inexpensive, the laser light can be easily modulated, and the life of the semiconductor laser is longer than those of the foregoing conventional lasers. Also, a light-sensitive material having a sensitivity in the infrared region can be used since the laser emits light in the infrared wavelength region. This allows a bright safelight to be used and handling of the light-sensitive material is simplified.

However, since the output of the semiconductor lasers which are presently available is not always high, the sensitivity of conventional light-sensitive materials for use in scanner systems employing semiconductor lasers is inadequate to carry out a scanning exposure of a large picture size in a short period of time. Accordingly, a light-sensitive material having an improved sensitivity in the infrared region has been demanded.

Known methods of increasing the sensitivity of photographic light-sensitive materials include increasing the grain size of the silver halide grains and adding various chemical sensitizers to the silver halide emulsion. These methods, however, are frequently accompanied by an increase in the graininess of the silver images and the formation of fog, and hence they are unsuitable for light-sensitive materials for use in scanner systems requiring a sharp image quality.

U.S. Pat. No. 4,975,362 discloses sensitizing dyes which are asserted to be effective for improving infrared sensitivity but these sensitizing dyes do not always provide a sufficiently high sensitivity to light sources of various wavelengths.

SUMMARY OF THE INVENTION

An object of the present invention is, therefore, to provide a silver halide photographic material having a high contrast and a sufficiently high sensitivity to infrared light.

A further object of the invention is to provide a silver halide photographic material suitable for forming images using a scanning system that employs a semiconductor laser as a light source.

A further object of the invention is to provide a silver halide photographic material whose sensitivity does not deteriorate during storage.

A still further object of the invention is to provide a silver halide photographic material which does not tend to fog during storage.

It has now been discovered that these objects can be achieved with a silver halide photographic material comprising a compound represented by following formula (I):

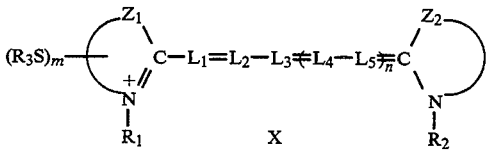

(I)

wherein $L_1$, $L_2$, $L_3$, $L_4$ and $L_5$ each represents a methine group which may be substituted; $Z_1$ represents a group of atoms necessary to form a benzothiazole nucleus, a benzoxazole nucleus, a benzoselenazole nucleus, or a benzimidazole nucleus; $Z_2$ represents a group of atoms necessary to form a benzothiazole nucleus, a naphthothiazole nucleus, a benzoxazole nucleus, a naphthoxazole nucleus, a benzoselenazole nucleus, a naphthoselenazole nucleus, a benzimidazole nucleus, a naphthoimidazole nucleus, or a 2-quinoline nucleus; $R_1$ and $R_2$ each independently represents an alkyl group, which may be substituted; $R_3$ represents an alkyl group having from 1 to 18 carbon atoms, which may be substituted; m represents an integer of from 2 to 4; n represents 0 or 1; and X represents a charge-balancing ion.

DETAILED DESCRIPTION OF THE INVENTION

The compounds represented by formula (I) for use in the present invention are described in detail below.

$Z_1$ represents a group of atoms necessary to form a benzothiazole nucleus (e.g., 6-methylthiobenzothiazole, 5,6-bismethylthiobenzothiazole, 5-chloro-6-methylthiobenzothiazole, 5-methyl-6-methylthiobenzothiazole, 5-methoxy-6-methylthiobenzothiazole, 4,6,7-trismethylthiobenzothiazole, 6-ethylthio-5-methylthiobenzothiazole), a benzoxazole nucleus (e.g., 6-methylthiobenzoxazole, 5,6-bismethylthiobenzoxazole, 5-chloro-6-methylthiobenzoxazole, 5-methyl-6-methylthiobenzoxazole, 5-methoxy-6-methylthiobenzoxazole), a benzoselenazole nucleus (e.g., 6-methylthiobenzoselenazole, 5,6-dimethylthiobenzoselenazole, 5-chloro-6-methylthiobenzoselenazole, 5-methyl-6-methylthiobenzoselenazole), or a benzimidazole nucleus (e.g., 5-methylthiobenzimidazole, 5,6-bismethylthiobenzimidazole, 5-chloro-6-methylthiobenzimidazole).

Of these nuclei, a benzothiazole nucleus and a benzoxazole nucleus are preferred.

In formula (I), the group of atoms represented by $Z_1$ may have a substituent in addition to —$SR_3$. Examples of such a substituent are a halogen atom ( e.g., F, Cl, and Br), an alkoxy group (e.g., methoxy, ethoxy, and 2-methoxyethoxy), an alkyl group (e.g., methyl, ethyl, isobutyl, and cyclohexyl), an aryl group (e.g., phenyl), an aralkyl group (e.g., benzyl), and a sulfonato group.

Examples of the heterocyclic group which is formed by the group of atoms represented by $Z_2$ include a benzothiazole or naphthothiazole nucleus (e.g., benzothiazole, 5-metylthiobenzothiazole, 5,6-bismethylthiobenzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-tolylfluoromethylbenzothiazole, 5,6-dimethylbenzothiazole, 5-hydroxy-6-methylbenzothiazole, tetrahydrobenzothiazole, 4-phenylbenzothiazole, naphtho-[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole), a benzoselenazole or naphthoselenazole nucleus (e.g., benzoselenazole, 5-chlorobenzoselenazole, 5-methylbenzoselenazole, 5-methoxybenzoselenazole, 5-methylbenzoselenazole, 5-hydroxybenzoselenazole, naphtho[2,1-d]selenazole, and naphtho[1,2-d]selenazole), a benzoxazole or naphthoxazole nucleus (e.g., benzoxazole, 5-chlorobenzoxazole, 5-methylbenzoxazole, 5-bromobenzoxazole, 5-methylthiobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, and naphtho[2,3-d]oxazole), a 2-quinoline nucleus (e.g., 2-quinoline, 3-methyl-2-quinoline, 5-ethyl-2-quinoline, 6-methyl-2-quinoline, 8-fluoro-2-quinoline, and 6-methoxy-2-quinoline), and a benzimidazole or naphthoimidazole nucleus (e.g., 1-methylbenzimidazole, 1-ethylbenzimidazole, 1-methyl-5-chlorobenzimidazole, 1-ethyl-5-chlorobenzimidazole, 1-ethyl-5-methylthiobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, and 1-ethylnaphtho[1,2-d]imidazole).

Of these nuclei, a thiazole nucleus and an oxazole nucleus are preferred. A benzothiazole nucleus and a benzoxazole nucleus are more preferred.

The alkyl group represented by $R_1$ and $R_2$ is preferably a straight chain, branched, or cyclic alkyl group having from 1 to 8 carbon atoms, and it may be substituted. If the alkyl group is substituted, it preferably has from 1 to 6 carbon atoms.

Examples of suitable substituents for the alkyl group represented by $R_1$ and $R_2$ include a carboxy group, a sulfo group, a cyano group, a halogen atom (e.g., fluorine, chlorine, and bromine), a hydroxy group, an alkoxycarbonyl group preferably having from 1 to 8 carbon atoms (e.g., methoxycarbonyl, ethoxycarbonyl, and benzyloxycarbonyl), an alkoxy group preferably having from 1 to 7 carbon atoms (e.g., methoxy, ethoxy, propoxy, butoxy, and benzyloxy), an alkylthio group (e.g., methylthio and 2-methylthioethylthio), an aryloxy group (e.g., phenoxy, p-tolyloxy, and $\alpha$-naphthoxy), an acyloxy group preferably having from 1 to 3 carbon atoms (e.g., acetyloxy and propionyloxy), an acyl group preferably having from 1 to 8 carbon atoms (e.g., acetyl, propionyl, benzoyl, and mesyl), a carbamoyl group (e.g., carbamoyl, N,N-dimethylcarbamoyl, morpholinocarbamoyl, and piperidinocarbamoyl), a sulfamoyl group (e.g., sulfamoyl, N,N-dimethylsulfamoyl and morpholinosulfonyl), and an aryl group (e.g., phenyl, p-hydroxyphenyl, p-carboxyphenyl, p-sulfophenyl, and $\alpha$-naphthyl), etc. The alkyl group represented by $R_1$ and $R_2$ may have two or more substituents.

The alkyl group represented by $R_3$ preferably has from 1 to 12 carbon atoms and may be substituted with a halogen atom (e.g., fluorine, chlorine, and bromine), an alkoxy group (e.g., methoxy and ethoxy), an aryloxy group (e.g., phenoxy), an alkylthio group (e.g., methylthio and ethylthio), an aryl group (e.g., phenyl and 2-pyridyl), a sulfonato group, a hydroxy group, a carboxy group, etc.

$R_3$ particularly preferably represents a lower alkyl group having from 1 to 6 carbon atoms. Preferred substituents in the case where $R_3$ is a substituted alkyl group include a fluorine atom, a methoxy group, an ethoxy group, a methylthio group, a sulfonato group, a carboxy group, and a hydroxy group.

The methine group represented by $L_1$ to $L_5$ may have a substituent such as an alkyl group (preferably having from 1 to 6 carbon atoms), an aryl group (e.g., phenyl), an aralkyl group (e.g., benzyl), an alkoxy group (e.g., methoxy and ethoxy), or an alkylthio group (e.g., methylthio and ethylthio). These substituents may be further substituted. Also, $L_2$ and $L_4$ may combine with each other to form a ring. The ring is preferably a 5- or 6-membered carbon ring.

More specifically, the ring formed by $L_2$ and $L_4$ preferably has a structure represented by following formula (a) or (b), which structure may have a further substituent:

(a)

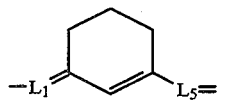

(b)

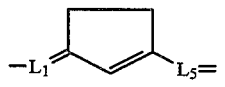

In formula (I), m is preferably 2 or 3.

The charge-balancing ion represented by X in formula (I) is a cation or an anion selected such that the sum of the charges of the compound represented by formula (I) is 0. X may form an inner salt as a substituent of $Z_1$, $Z_2$, $R_1$, $R_2$, etc.

Examples of suitable cations represented by X include $Na^+$, $K^+$, $NH_4^+$, $(n—C_4H_9)_4N^+$, etc. Examples of suitable anions represented by X include acid anions (e.g., a chloride ion, a bromide ion, a tetrafluoroborate ion, a hexafluorophosphate ion, a methylsulfate ion, an ethylsulfate ion, a benzenesulfonate ion, a 4-methylbenzenesulfonate ion, a 4-chlorobenzenesulfonate ion, a 4-nitrobenzenesulfonate ion, a trifluoromethanesulfonate ion, and a perchlorate ion).

Of the compounds represented by formula (I), compounds represented by the following formula (II) are preferred:

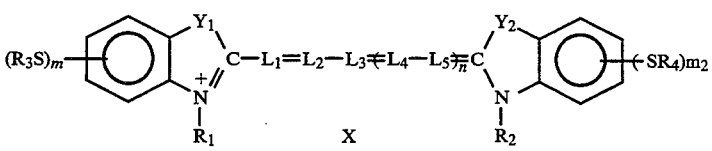

(II)

wherein $L_1$ to $L_5$, $R_1$, $R_2$, $R_3$, m, X and n have the same meaning as in formula (I); $Y_1$ and $Y_2$ each represents O, S, or Se; $R_4$ represents a group having the same meaning as $R_3$ in formula (I) and which may be the same as or different from $R_3$ in formula (II); and $m_2$ represents an integer of from 1 to 4.

Furthermore, of the compounds represented by formula (I), the compounds represented by the following formula (III) are particularly preferred:

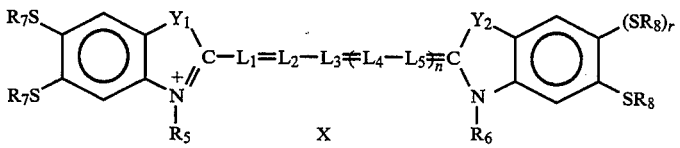

(III)

wherein $L_1$ to $L_5$, X and n have the same meaning as in formula (I); $Y_1$ and $Y_2$ have the same meaning as in formula (II); $R_7$ and $R_8$ each represents a lower alkyl group having from 1 to 6 carbon atoms; $R_5$ and $R_6$ each represents a lower alkyl group having from 1 to 6 carbon atoms, which may have a substituent selected from the substituents described above as substituents for the groups represented by $R_1$ and $R_2$ in formula (I) and; r represents 0 or 1. Particularly preferred substituents include a fluorine atom, a carboxy group, a hydroxy group, a sulfonato group, a lower alkoxy group (e.g., methoxy and ethoxy), and an aryloxy group (e.g., 1-naphthoxy and 2-naphthoxy).

Specific examples of the compounds represented by formula (I) are illustrated below, but the invention should not be construed as limited to these compounds.

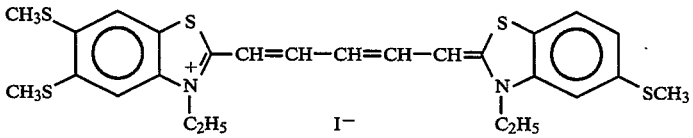

I-1

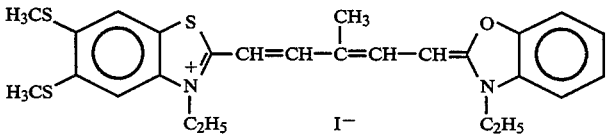

I-2

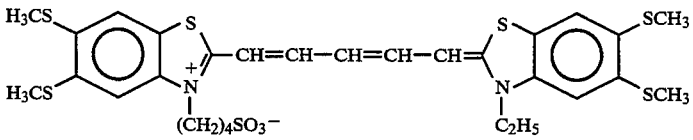

I-3

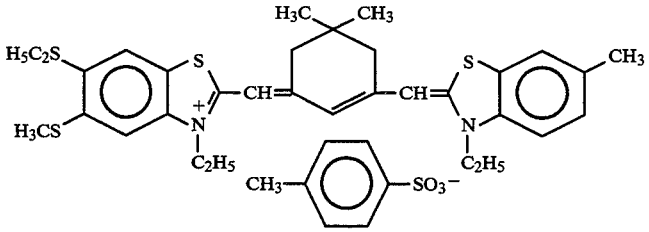

I-4

-continued
I-5
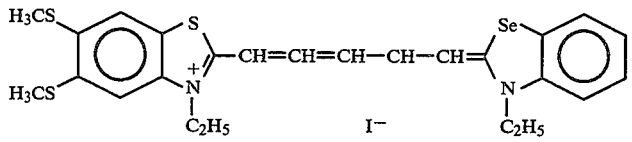
I-6
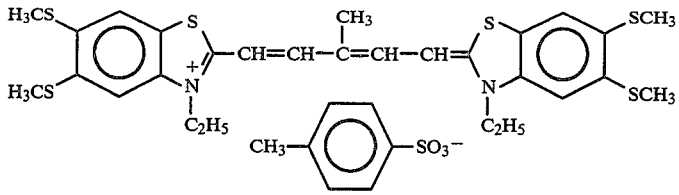
I-7
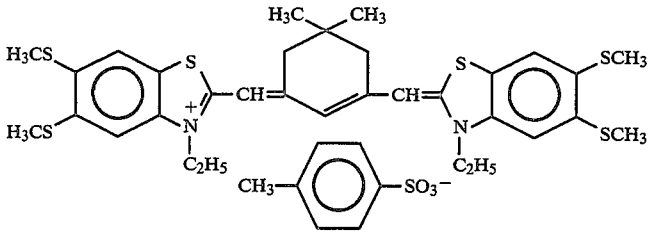
I-8
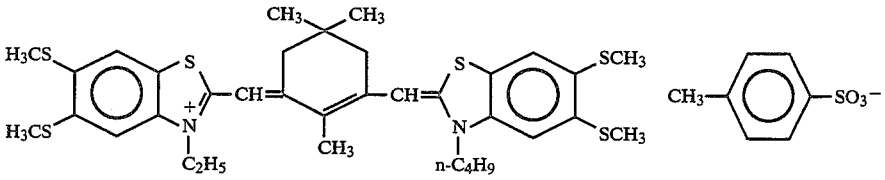
I-9
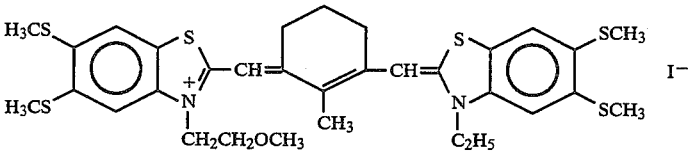
I-10
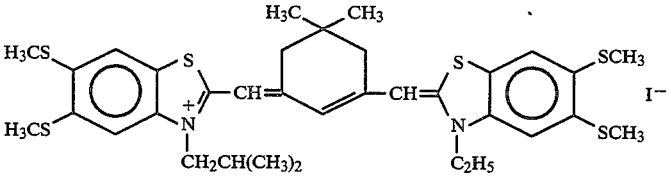
I-11
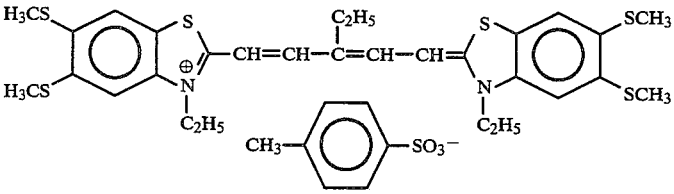
I-12
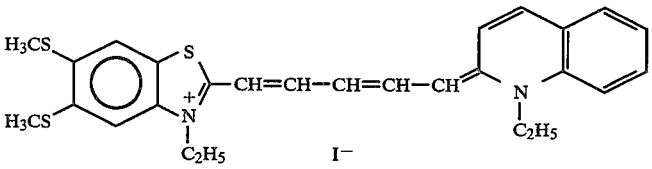
I-13
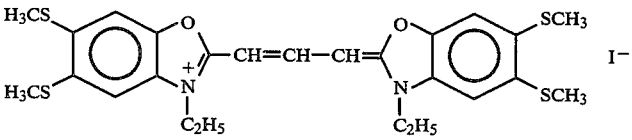

-continued
I-14
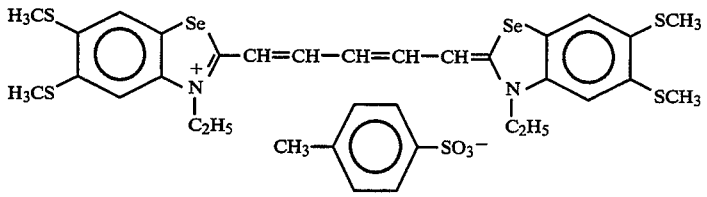
I-15
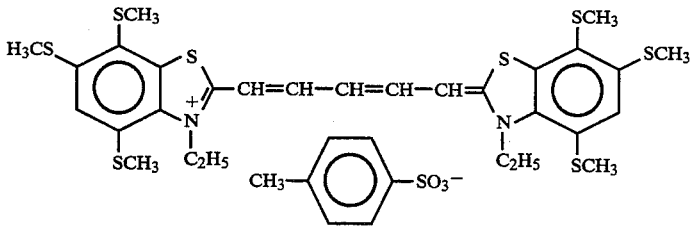
I-16
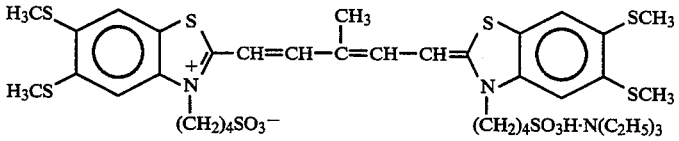
I-17
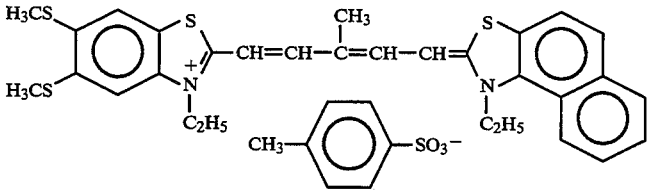
I-18
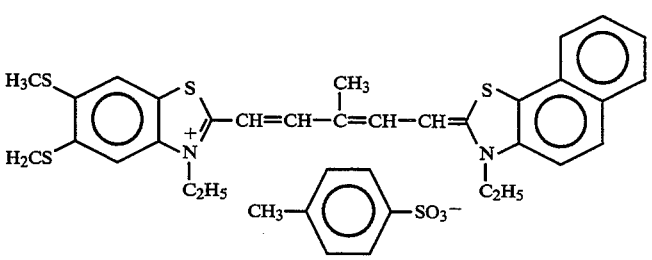
I-19
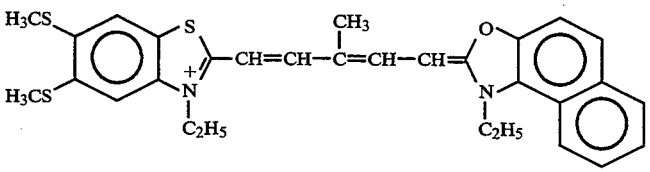
I-20
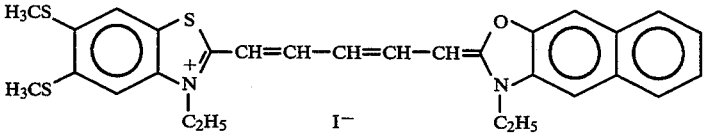
I-21
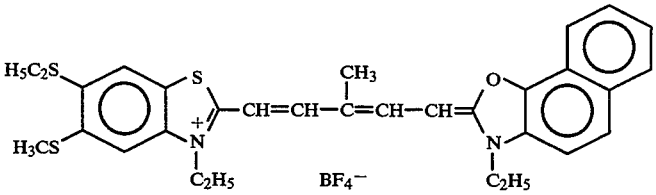

-continued

I-22

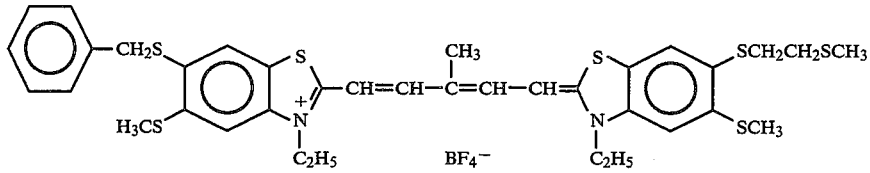

I-23

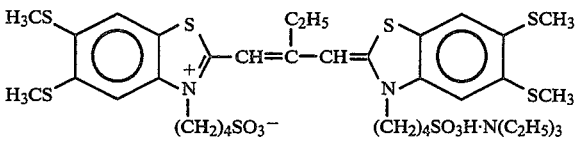

I-24

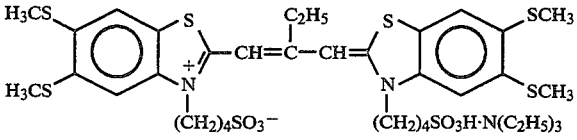

I-25

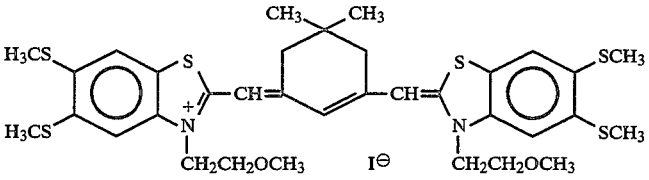

I-26

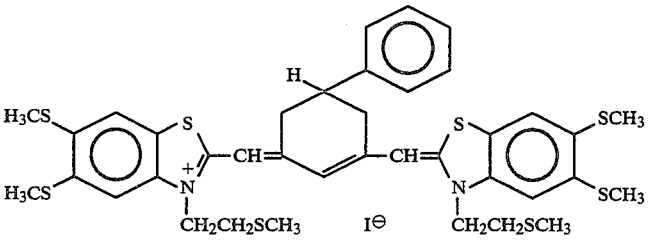

The compounds represented by formula (I) for use in the present invention can be synthesized by referring to known synthesis methods.

For example, U.S. Pat. No. 4,975,362 discloses a synthesis method of a tricarbocyanine having a methylthio group-containing benzothiazole nucleus, and *Research Disclosure* No. 17363, Vol. 173 (September 1978) discloses a synthesis method of a carbocyanine and a dicarbocyanine each having a methylthio group.

A specific example of a synthesis method of a compound represented by formula (I) for use in the present invention is set forth below:

SYNTHESIS EXAMPLE

Synthesis of Compound I-6:

A mixture of 0.8 g of 3-ethyl-2-methyl-5,6-bismethylthiobenzothiazolium para-toluenesulfonate, 7 ml of 1,1,3,3-tetraethoxy-2-methylpropane, 12 ml of acetic anhydride, and 2.5 ml of acetic acid was stirred for 30 minutes while being heated on a steam bath. After cooling the reaction mixture to room temperature by immersing the reaction vessel in water, 75 ml of ethyl acetate was added to the mixture followed by stirring. The precipitates thus formed were recovered by filtration and then washed with a small amount of ethyl acetate to provide 0.91 g of crude crystals of 2-(4-ethoxy- 3-methyl-1,3-butadien-1-yl)-3-ethyl-5,6-bismethylthiobenzothiazolium paratoluenesulfonate. 20 ml of ethanol, 0.75 g of 3-ethyl-2-methyl-5,6-bismethylthiobenzothiazolium paratoluenesulfonate, and 0.3 ml of triethylamine were added to the crystals, and the resultant mixture was stirred for 20 minutes while being heated on a steam bath. The reaction mixture was cooled to room temperature.

The crystals thus precipitated were recovered by filtration and 100 ml of ethanol and 40 ml of chloroform were added to the crystals followed by refluxing to dissolve the crystals therein. Then, 60 ml of the solvents were distilled off and the residue was cooled by immersing the reaction vessel in water and recrystallized. The crystals thus obtained were washed with ethanol and dried to provide 1.1 g of the desired compound I-6. The melting point of the compound was from 234° C. to 236° C. and λmax($CH_3OH$) were equal to 685 nm.

The silver halide emulsion for use in the present invention may contain any of silver bromide, silver iodobromide, silver iodochlorobromide, silver chlorobromide, or silver chloride.

The silver halide grains may have a regular crystal form such as cubic, octahedral, tetradecahedral, rhombic dodecahedral, etc., an irregular crystal form such as tabular, spherical, etc., or they may have a composite form of these crystal forms. Also, the silver halide grains may be composed of a mixture of grains having various crystal forms.

The silver halide emulsions which are preferred for use in the present invention are described in detail below.

The silver halide emulsions for use in the present invention can be prepared using the methods described in P. Glafkides, *Chimie et Phisique Photographique*, (published by Paul Montel Co., 1967), G. F. Duffin, *Photographic Emulsion Chemistry*, (published by Focal Press Co., 1966), V. L. Zelikman et al, *Making and Coating Photographic Emulsion*, (published by Focal Press Co., 1964), etc. That is, an acidic method, a neutralization method, an ammonia method, etc., can be used. Also, as a system of reacting a soluble silver salt and a soluble halide, a single jet method, a double jet method, or a combination thereof may be used. Further, a so-called reverse mixing method of forming silver halide grains in a state of excessive silver ions can be used. As one of the double jet methods, a so-called controlled double jet method in which a constant pAg is maintained in the liquid phase in which the silver halide grains are formed can also be used. With this method, a silver halide emulsion containing silver halide grains having a regular crystal form and nearly uniform grain size can be obtained.

As the foregoing tabular silver halide grains, tabular grains having a thickness not greater than 0.5 μm, and preferably not greater than 0.3 μm, a circular-corresponding diameter preferably of at least 0.6 μm, and an aspect ratio (circular-corresponding diameter/thickness) of at least 5, preferably account for at least 50% (area) of the total silver halide grains.

The silver halide grains may have a different phase between the inside thereof and the surface layer thereof or they may be composed of a homogeneous phase throughout the grain. Also, the silver halide grains may be a type which forms a latent image mainly on the surface of the grains (e.g., a negative-working silver halide emulsion) or they may be a type which forms a latent image mainly in the inside of the grains (e.g., an internal latent image-type silver halide emulsion). Furthermore, core/shell type silver halide grains can be used in the present invention.

In preparing the silver halide emulsion for use in the present invention, various polyvalent metal ion impurities can be introduced therein in the step of forming the silver halide grains or physical ripening. Examples of such compounds include salts of cadmium, zinc, lead, copper, thallium, etc., or salts or complex salts of the elements belonging to Group (VIII) of the periodic table, such as iron, ruthenium, rhodium, palladium, osmium, iridium, platinum, etc. In particular, use of salts or complex salts of the elements belonging to Group (VIII) is preferred. The amount of the compound can be suitably selected in a wide range according to the purpose but it is preferably from $1\times10^{-9}$ to $1\times10^{-2}$ mol per mol of silver halide.

The silver halide emulsion for use in the present invention may be chemically sensitized and/or spectrally sensitized. As a chemical sensitizing method, a sulfur sensitization typified by the addition of an unstable sulfur compound, a noble metal sensitization typified by a gold sensitization, or a reduction sensitization can be used singly or in combination. As the compounds used for the chemical sensitization, the compounds described in JP-A-62-215272, page 18, right lower column to page 22, right upper column can be preferably used. (The term "JP-A" as used herein means an "unexamined published Japanese patent application").

Various compounds or precursors thereof can be added to the silver halide emulsion used in the present invention to inhibit fog formation during the production, storage or photographic processing of the silver halide photographic material or to stabilize the photographic performance of the material. Specific examples of these compounds are described in JP-A-62-215272, pages 39 to 72.

The silver halide emulsion for use in the present invention is preferably a so-called surface latent image type emulsion .which forms a latent image mainly on the surfaces of the silver halide grains.

In cases where a semiconductor laser is used as a digital exposure light source, it is necessary to efficiently spectrally sensitize the silver halide emulsion in the infrared region.

Since for an infrared sensitization, sensitization using the M band of a sensitizing dye is used, the spectral sensitizing distribution is generally broader than the sensitization using the J band. Accordingly, it is preferred to correct the spectral sensitizing distribution by forming a colored layer containing a dye on a colloid layer disposed further than the light-sensitive emulsion layer sensitized using the M band from the support. The colored layer also has a filter effect which is effective for preventing the occurrence of color mixing.

To incorporate a sensitizing dye in the silver halide emulsion, the spectral sensitizing dye may be added to the emulsion directly or as a solution of the dye in a solvent such as water, methanol, ethanol, propanol, methyl cellosolve, 2,2,3,3-tetrafluoropropanol, etc. The solvents may be used singly or as mixtures thereof. Furthermore, the spectral sensitizing dye may be added to the silver halide emulsion as an aqueous solution of the dye and an acid or a base as described in JP-B-44-23389, JP-B-44-27555, JP-B-57-22089, etc., (the term "JP-B" as used herein means an "examined Japanese patent publication") or the dye may be added as an aqueous solution or a colloid dispersion which contains a surfactant as described in U.S. Pat. Nos. 3,822,135 and 4,006,025. Also, after dissolving the spectral sensitizing dye in a solvent which is substantially immiscible with water, such as phenoxy ethanol, etc., the solution may be dispersed in water or an aqueous hydrophilic colloid solution, and the dispersion may be added to the silver halide emulsion. Also, the spectral sensitizing dye may be directly dispersed in an aqueous hydrophilic colloid solution and the dispersion may be added to the silver halide emulsion as described in JP-A-53-102733 and JP-A-58-105141.

The spectral sensitizing dye may be added to the silver halide emulsion at any point in the emulsion preparation process which is known to be effective for the addition of such dyes. That is, the spectral sensitizing dye can be added before the formation of the silver halide grains of the silver halide emulsion, during the formation of the silver halide grains, from directly after the formation of the silver halide grains to before the start of a washing step, before the chemical sensitization of the silver halide emulsion, during the chemical sensitization, from directly after the chemical sensitization of the emulsion to the solidification of the emulsion by cooling, and during the preparation of the coating composition of the emulsion.

Ordinarily, the dye is added after the completion of the chemical sensitization step but before coating. However, the spectral sensitizing dye can be added at the same time the chemical sensitizer is added to simultaneously carry out the spectral sensitization and the chemical sensitization as described in U.S. Pat. Nos. 3,628,969 and 4,225,666. Further, the spectral sensitizing dye may be added before the chemical sensitization as described in JP-A-58-113928, or it may be added before completing the formation of the silver halide grain precipitates. Furthermore, the spectral sensitizing dye can be added in separate steps, that is, a part of the dye may be added before the chemical sensitization and the remainder can be added after the chemical sensitization as described in U.S. Pat. No. 4,225,666. Still further, the addition of the spectral sensitizing dye may be carried out by the method disclosed in U.S. Pat. No. 4,183,756 and it may be carried out at any step during the formation of the silver halide grains.

Of these addition methods, it is particularly preferred to add the sensitizing dye either before the step in which the silver halide emulsion is washed or before the emulsion is chemically sensitized.

The amount of the spectral sensitizing dye to be added can be selected from a wide range according to the purpose but the amount is preferably in the range of from $0.5\times10^{-6}$ to $1.0\times10^{-2}$ mol, and more preferably in the range of from $1.0\times10^{-6}$ to $5.0\times10^{-3}$ mol per mol of silver halide.

For the M band type sensitization in a red or infrared sensitization in the present invention, supersensitization using the compounds described in JP-A-2-157749, page 13, right lower column, line 3 to page 22, right lower column, line 3 from the bottom is particularly effective.

In the silver halide photographic material of the present invention, it is preferred that a dye, and in particular, an oxonol dye, capable of being decolored by photographic processing as described in EP-A-0337490, pages 27 to 76, be added to a hydrophilic colloid layer of the photographic material such that the optical reflection density of the silver halide photographic material at a wavelength of 680 nm is 0.70 or higher to improve the sharpness of the image. It is also preferred that titanium oxide which has been surface-treated with a dihydric to tetrahydric alcohol (e.g., trimethylolethane), etc., be added to a water-resistant resin layer of the support in an amount of at least 12% by weight, and more preferably at least 14% by weight.

In the silver halide photographic material of the present invention, colloidal silver and various types of dyes may be used to inhibit irradiation, to inhibit halation, and, in particular, to separate the spectral sensitivity distribution of each silver halide photographic emulsion layer and ensure the safety of the light-sensitive material under a safelight.

In the silver halide photographic material of the present invention, it is preferred to use compounds for improving the color image storage stability as described in EP-A-0277589 together with couplers. The use of such compounds in combination with pyrazoloazole couplers is particularly preferred.

In the silver halide photographic material of the present invention, it is preferred to incorporate antifungal agents as described in JP-A-63-271247 in a hydrophilic colloid layer of the material to inhibit the growth of various fungi and bacteria which tend to deteriorate images.

As the support for use in the silver halide photographic material of the present invention, a white polyester support or a support having a layer containing a white pigment on the side of the support carrying the silver halide emulsion layer can be used if the final image will be used for display.

To improve the sharpness of the images formed, it is preferred to provide an antihalation layer on the silver halide emulsion layer side or the back side of the support. In particular, it is preferred to set the transmission density of the support in the range of from 0.35 to 0.8 such that the image formed on the support can be observed by both reflected light and transmitted light.

The exposed silver halide photographic material of the present invention can be subjected to black-and-white photographic processing or color photographic processing. In the case of processing a color photographic light-sensitive material, it is preferred to apply bleach-fix (blix) processing after color development to achieve rapid processing. In particular, in the case of using a high-silver chloride emulsion, the pH of the blix solution is preferably not higher than about 6.5, and more preferably not higher than about 6 in order to accelerate desilvering.

Preferred cyan couplers for use in the silver halide photographic material of the present invention include the diphenylimidazole cyan couplers described in JP-A-2-33144; the 3-hydroxypyridine cyan couplers described in EP-A-0333085, particularly preferably Coupler (42) converted into a two-equivalent coupler by bonding a chlorine-releasing group to a four-equivalent coupler and Couplers (6) and (9) illustrated as the practical examples; and the cyclic active methylene cyan couplers described in JP-A-64-32260, particularly preferably couplers 3, 8 and 34 illustrated as practical examples.

The processing temperature of the color developer which can be used to develop the photographic light-sensitive material of the present invention is typically from 20° C. to 50° C., and preferably from 30° C. to 45° C.

It is preferred that the developing time be 20 seconds or less. The developing time is the time required for the light-sensitive material to enter the developer bath, pass through it, and enter the subsequent bath, including the crossover time from the developer bath to the subsequent bath.

The replenishing amount for the color developer is preferably as small as possible, but is suitably from 20 to 600 ml, preferably from 50 to 300 ml, more preferably from 60 to 200 ml, and most preferably from 60 to 150 ml per square meter of the light-sensitive material being processed.

The pH of the wash step or the stabilization step is preferably from 4 to 10, and more preferably from 5 to 8. The temperature of the wash or stabilization step can be selected appropriately according to the use and the characteristics of the light-sensitive material being processed, but it is generally from 30° C. to 45° C., and preferably from 35° C. to 42° C. The processing time for the wash or stabilization step can be suitably selected but a shorter time is preferred from the standpoint of reducing the processing time. The processing time is preferably from 10 to 45 seconds, and more preferably from 10 to 40 seconds. The replenishing amount for the wash or stabilization step is preferably as small as possible to reduce running costs and the amount of waste liquids, and to simplify handling.

The preferred replenishing amount of the wash solution or the stabilization solution is from 0.5 to 50 times, and particularly preferably from 2 to 15 times the carry-over amount from the preceding bath per unit area of light-sensitive material being processed. The replenisher may be replenished continuously or intermittently.

The solution used for the washing step and/or the stabilization step can be further used for the preceding step. For example, the overflow solution of wash water may be introduced into a blix bath, which would be the preceding bath in this case, and a condensed blix solution would then be supplied to the blix bath, thereby reducing the amount of waste solution.

The wash water overflow may be reduced by using a multistage countercurrent system.

A drying step which can be used in the present invention is described below.

To complete the formation of images by a very rapid processing process in the present invention, it is desirable that the drying time be from 20 to 40 seconds. To shorten the drying time, the amount of hydrophilic binder such as gelatin in the photographic material may be reduced to reduce the amount of water carried in the photographic layers. Also, to reduce the amount of water carried in the photographic material and thereby reduce the drying time, water can be expelled from or absorbed from the photographic material immediately upon its emergence from the wash bath using squeeze rollers or a cloth. As to the drying means, as a matter of course, drying can be quickened by increasing the drying temperature or strengthening the drying blast. Furthermore, by controlling the angle of the drying blast relative to the light-sensitive material being processed and by improving the method of removing the exhaust air, drying can also be quickened.

The invention is illustrated in the following example, but should not be construed as limited to this example.

EXAMPLE 1

Preparation of Emulsion

Emulsion A: A 0.13M aqueous solution of silver nitrate and an aqueous halide solution containing potassium bromide (0.04M) and sodium chloride (0.09M) were added over a period of 12 minutes to an aqueous gelatin solution containing sodium chloride and 1,8-dihydroxy- 3,6-dithiaoctane using a double jet method with stirring at 45° C. to form silver chloride grain nuclei having a mean grain size of 0.15 μm and a silver chloride content of 70 mol %.

Then, a 0.87M aqueous solution of silver nitrate and an aqueous halide solution containing potassium bromide (0.26M) and sodium chloride (0.65M) were added to the foregoing reaction mixture over a period of 20 minutes using a double jet method. Thereafter, the reaction product was washed with water using a conventional flocculation method, 40 g of gelatin were added to the reaction mixture, and the pH and pAg of the reaction mixture were adjusted to 6.5 and 7.5, respectively. Furthermore, 5 mg of sodium thiosulfate and 8 mg of chloroauric acid per mol of silver were added to the mixture followed by heating the mixture to 60° C. for 75 minutes to effect a chemical sensitization treatment, and then 150 mg of 1,3,3*a*,7-tetraazindene were added to the mixture as a stabilizer. The silver halide grains thus obtained were cubic silver chlorobromide grains having a mean grain size of 0.28 μm and a silver chloride content of 70 mol % (coefficient of variation 10%).

Preparation of Coated Sample Nos. 1 to 7

The emulsion prepared above was divided into seven individual 1 kg portions. The sensitization of the infrared region was then carried out by adding 60 ml of a 0.05 weight % solution of a sensitizing dye as shown in Table 1 below to each 1 kg portion of the silver halide emulsion. 70 ml of a 0.5 weight % methanol solution of disodium 4,4'-bis(4,6-dinaphthoxypyrimidin-2-ylamino)stilbendisulfonate and 90 ml of a 0.5 weight % methanol solution of 2,5-dimethyl-3-allylbenzothiazole iodide were added to each emulsion portion to effect supersensitization and stabilization.

Then, after further adding 100 mg/m$^2$ of hydroquinone, a polyethyl acrylate latex as a plasticizer in an amount of 25% based on the weight of the binder, and 86.2 mg/m$^2$ of 2-bis(vinylsulfonylacetamido)ethane as a hardening agent to each portion of the silver halide emulsion, each emulsion was coated on a polyester support at a silver coverage of 3.7 g/m$^2$. The coverage of gelatin was 2.5 g/m$^2$.

Next, the following protective layers were simultaneously coated on each silver halide emulsion layer: an upper protective layer containing 0.6 g/m$^2$ of gelatin, 60 mg/m$^2$ of polymethyl methacrylate particles having particle sizes of from 3 to 4 μm as a matting agent, 70 mg/m$^2$ of colloidal silica having particle sizes of from 10 to 20 mμ, 10 mg/m$^2$ of a silicone oil, and sodium dodecylbenzenesulfonate and a fluorine surfactant having following structure (1) as coating aids, and a lower protective layer containing 0.7 g/m$^2$ of gelatin, 225 mg/m$^2$ of a polyethyl acrylate latex, 20 mg/m$^2$ of a dye having following structure (2), 10 mg/m$^2$ of a dye having following structure (3), and sodium dodecylbenzenesulfonate as a coating aid, to prepare Sample Nos. 1 to 7:

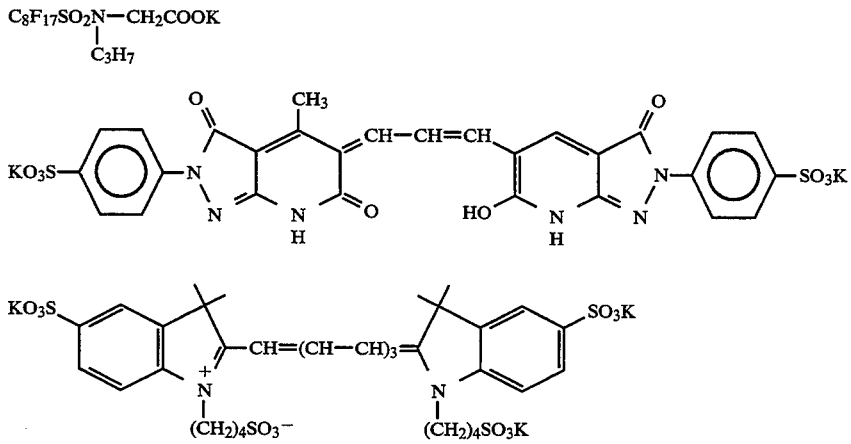

In addition, the base support used in each sample had a backing layer having the following composition and a backing protective layer having the following composition. (The swelling ratio of the backing layer was 110%.)

| | |
|---|---|
| Backing Layer | |
| Gelatin | 3.0 g/m$^2$ |
| Sodium Dodecylbenzensulfonate | 80 mg/m$^2$ |
| Dye (a) shown below | 80 mg/m$^2$ |
| Dye (b) shown below | 30 mg/m$^2$ |
| Dye (c) shown below | 100 mg/m$^2$ |
| 1,3-Divinylsulfonyl-2-propanol | 60 mg/m$^2$ |
| Polyvinyl-Potassium Benzenesulfonate | 30 g/m$^2$ |
| Backing Protective Layer | |
| Gelatin | 0.75 g/m$^2$ |
| Polymethyl Methacrylate (particle size: 4.7 μm) | 30 mg/m$^2$ |
| Sodium Dodecylbenzenesulfonate | 20 mg/m$^2$ |
| Fluorine Surfactant (Compound (1) described above) | 2 mg/m$^2$ |
| Silicone Oil | 100 mg/m$^2$ |

Dye (a):

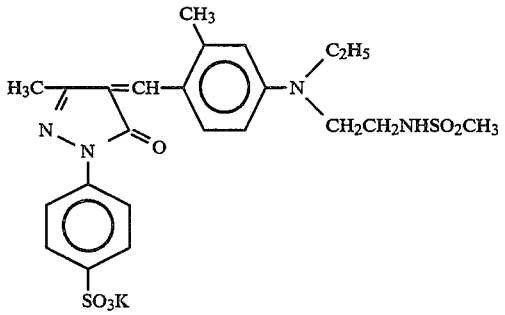

Dye (b):

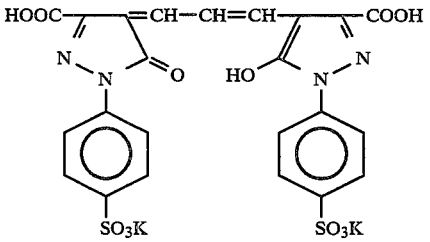

Dye (c):

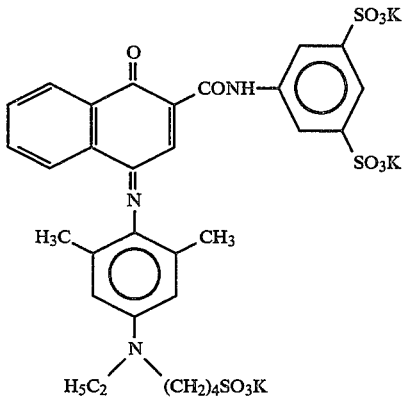

Evaluation of Photographic Performance

Each of Sample Nos. 1 to 7 thus obtained was exposed using a xenon flash light having a light emitting time of $10^{-6}$ seconds through an interference filter having a peak at a wavelength of 750 nm and a continuous wedge. Each sample was developed for 20 seconds at 38° C., fixed, washed, and dried using an automatic processor, FG-360G (trade name, manufactured by Fuji Photo Film Co., Ltd.) using a developer and a fixing solution having the compositions set forth below. The wash tank volume of the processor was 6 liters.

| | |
|---|---|
| Developer Formula | |
| Water | 720 ml |
| Disodium Ethylenediaminetetraacetate | 4 g |
| Sodium Hydroxide | 44 g |
| Sodium Sulfite | 45 g |
| 2-Methylimidazole | 2 g |
| Sodium Carbonate | 26.4 g |
| Boric Acid | 1.6 g |
| Potassium Bromide | 1 g |
| Hydroquinone | 20 g |
| Diethylene Glycol | 39 g |
| 5-Methyl-benzotriazole | 0.2 g |
| Pyrazolone | 0.7 g |
| Water to make | 1 liter |
| Fixing Solution Formula | |
| Ammonium Thiosulfate | 170 g |
| Sodium Sulfite (anhydrous) | 15 g |
| Nitric Acid | 7 g |
| Glacial Acetic Acid | 15 ml |
| Potassium Alum | 20 g |
| Ethylenediaminetetraacetic Acid | 0.1 g |
| Tartaric Acid | 3.5 g |
| Water to make | 1 liter |

Each of the processed Sample Nos. 1 to 7 were subjected to a sensitometric evaluation. The sensitivities were measured as relative sensitivities using the reciprocal of the exposure amount giving a density of 3.0 as the standard exposure. The gradation was shown in terms of a slope of a straight line obtained by connecting two points of densities 0.1 and 3.0 with each other on the characteristic curve.

Also, a second set of samples was allowed to stand in an atmosphere of a pressure of 50 kg/m$^2$ for 7 days at 50° C., and the same exposure, processing, and sensitometric evaluation as above were carried out for each sample.

The results obtained are shown in Table 1 below.

TABLE 1

| Sample No. | Sensitizing Dye | Relative Sensitivity | Relative Sensitivity After Storage |
|---|---|---|---|
| 1 | Comparison Compound A | 100 (standard) | 73 |
| 2 | Comparison Compound B | 120 | 102 |
| 3 | Comparison Compound C | 112 | 104 |
| 4 | I-6 | 140 | 136 |
| 5 | I-7 | 132 | 129 |
| 6 | I-17 | 164 | 160 |
| 7 | I-18 | 158 | 155 |

Sample Nos. 1 to 3: Comparison Samples
Sample Nos. 4 to 7: Samples of the Invention The structures of the Comparison Compounds A, B and C used in Sample Nos. 1 to 3 are shown below:

Comparison Compound A:

-continued

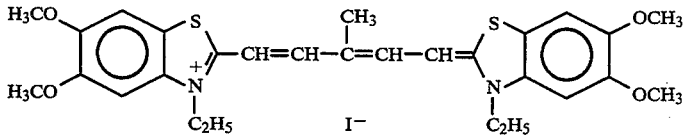

Comparison Compound B:

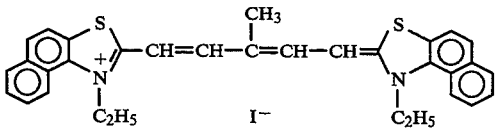

Comparison Compound C:

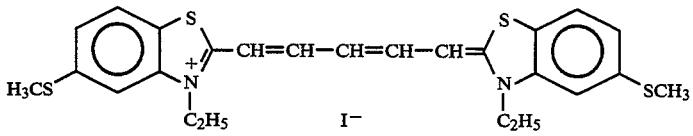

The results in Table 1 show that the samples containing the compounds represented by formula (I) for use in the present invention had higher sensitivities and smaller decreases in sensitivity after storage than the comparison samples containing conventionally known compounds having structures similar to the compounds of formula (I) of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having formed thereon at least one silver halide emulsion layer, wherein said silver halide emulsion layer contains a dye represented by formula (III ):

(III)

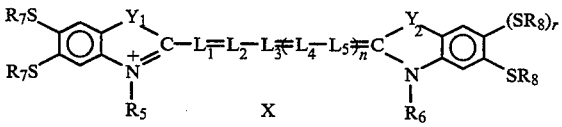

wherein $L_1$, $L_3$ and $L_5$ each represents a methine group; $L_2$ and $L_4$ each represents a methine group or $L_2$ and $L_4$ may combine with each other to form a ring; n represents 1; and X represents a charge-balancing ion; $Y_1$ and $Y_2$ each represents O, S, or Se; $R_5$ and $R_6$ each represents a substituted or unsubstituted lower alkyl group having from 1 to 6 carbon atoms; $R_7$ and $R_8$ each represents a lower alkyl group having from 1 to 6 carbon atoms; and r represents 0 or 1; and a hydrogen atom replaces the thioalkyl group $SR_8$ when r is 0.

2. The silver halide photographic material of claim 1, wherein the silver halide emulsion layer comprises a surface latent image type emulsion.

* * * * *